United States Patent [19]

Malm et al.

[11] 4,428,156

[45] Jan. 31, 1984

[54] REINFORCED WINDOW ASSEMBLY

[75] Inventors: Douglas N. Malm; James D. Hall, both of South Bend, Ind.

[73] Assignee: Mastic Corporation, South Bend, Ind.

[21] Appl. No.: 307,897

[22] Filed: Oct. 2, 1981

[51] Int. Cl.[3] ..... E06B 3/00

[52] U.S. Cl. ..... 49/501; 49/504; 52/730

[58] Field of Search ..... 49/501, 504; 52/476, 52/730, 731, 490

[56] References Cited

U.S. PATENT DOCUMENTS

| | | | |
|---|---|---|---|
| 2,847,065 | 8/1958 | Tolman et al. | 49/501 X |
| 3,090,083 | 5/1963 | Emmerich | 49/483 X |
| 3,352,074 | 11/1967 | Schwartzberg | 49/504 X |
| 4,240,235 | 12/1980 | Nawa | 49/501 X |

*Primary Examiner*—Kenneth Downey
*Attorney, Agent, or Firm*—James D. Hall

[57] ABSTRACT

A sash assembly for a glazing panel. The sash members of the assembly are formed with a concave inner surface which contains a rigid reinforcement member.

7 Claims, 5 Drawing Figures

REINFORCED WINDOW ASSEMBLY

SUMMARY OF THE INVENTION

This invention relates to a window assembly and will have specific but not limited application to the sash assembly for the window glazing panel.

The sash assembly includes sash members connected at their ends for containing and supporting the glazing panel. The sash members are each formed with a base and spaced side walls. A rigid support is held between the side walls of each sash member by engaging finger parts. The sash members are preferably of extruded construction and are formed with an open compartment which allows for greater ease and speed of production. Such open compartment construction permits the use of extrusion dies and downstream forming equipment which are simpler and less expensive than conventional equipment. Also, cooling and forming of the extruded material is speeded since all sides of the sash member may be uniformly cooled rather than only the exterior of an enclosed compartment. This also yields a sash member having a more uniform shape and less internal stress. The rigid support inserted within the sash member is used to pull the side walls of the sash member together and provide strength without the necessity of utilizing webbing between the side walls which forms an enclosed compartment.

Accordingly, it is an object of this invention to provide a novel sash assembly for a window.

Another object of this invention is to provide a glazing panel support assembly wherein the sash and frame members have an open compartment construction.

Another object of this invention is to provide a sash for a window assembly having a construction which allows for greater ease and speed of production and yet provide sufficient support for the glazing panel.

Other objects of this invention will become apparent upon reading of the following description.

DESCRIPTION OF THE PREFERRED EMBODIMENTS

Figure 1:
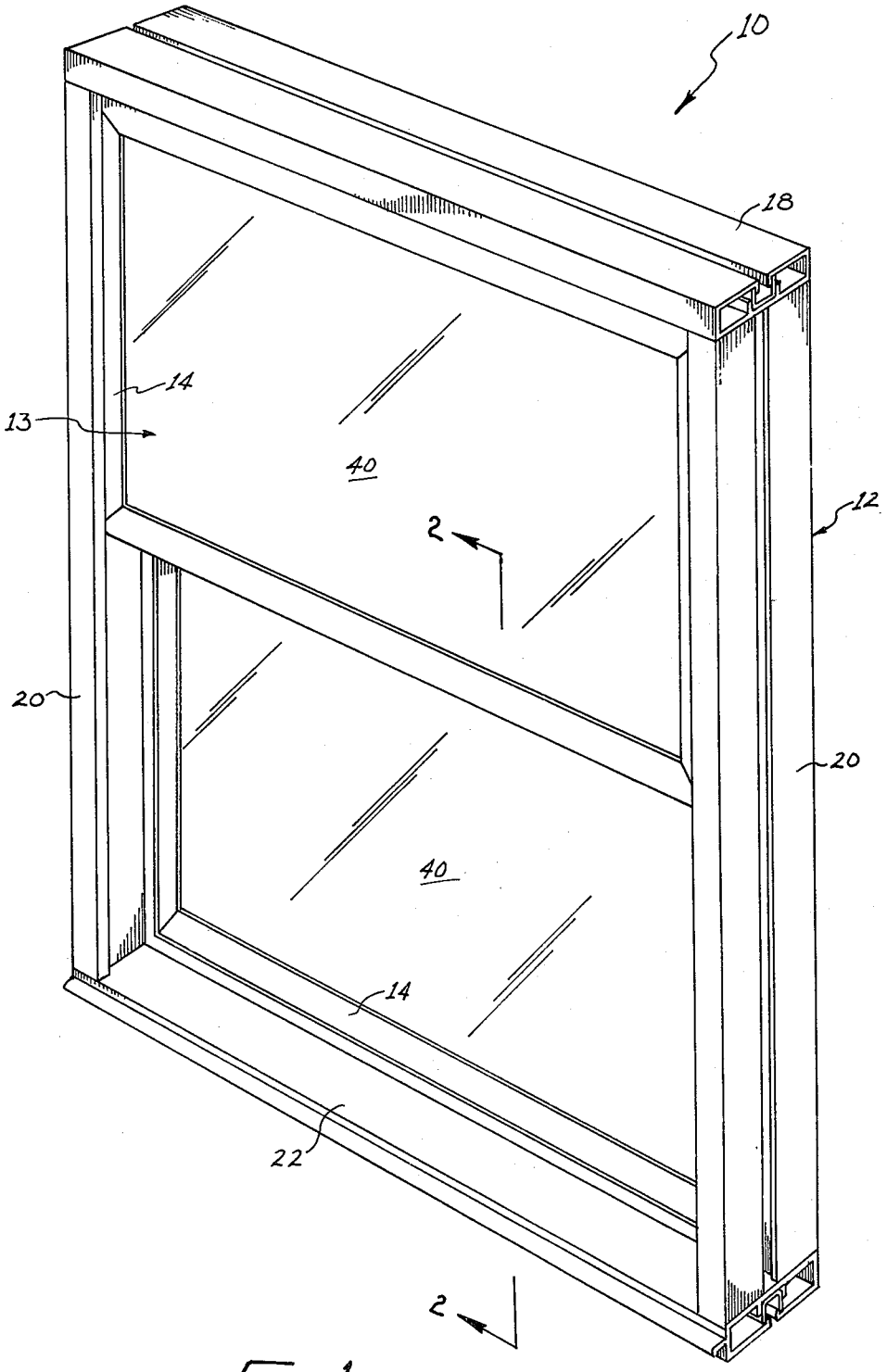
FIG. 1 is a perspective view of a window assembly.

The preferred embodiments illustrated are not intended to be exhaustive or to limit the invention to the precise form disclosed. They are chosen and described in order to explain the principle of the invention and its application and practical use to thereby enable others skilled in the art to utilize the invention.

The window assembly 10 includes a frame 12 which retains and guides the window panel 13. Each window panel 13 includes glazing panels 40 and sash members 14. Frame 12 fits within a window opening of a building 5 and is retained therein with fastening means (not shown). Frame 12 and sash members 14 are preferably formed of an extruded material such as vinyl.

Frame 12 includes side parts, such as a header part 18, jamb parts 20 and a sill part 22. Each window panel 13 is shiftably supported for vertical movement by frame jamb parts 20. Each frame part such as sill part 22, is of an open compartment construction and of uniform cross-section, having an inner side 23, an outer side 25, and connecting ends 26. Outer side 25 is longitudinally slotted at 27 with each side section terminating in an inturned lip 28. A pair of legs 30 projects from inner side 23 toward lips 28 with each leg being slightly outset from the plane of a lip 28.

Figure 2:
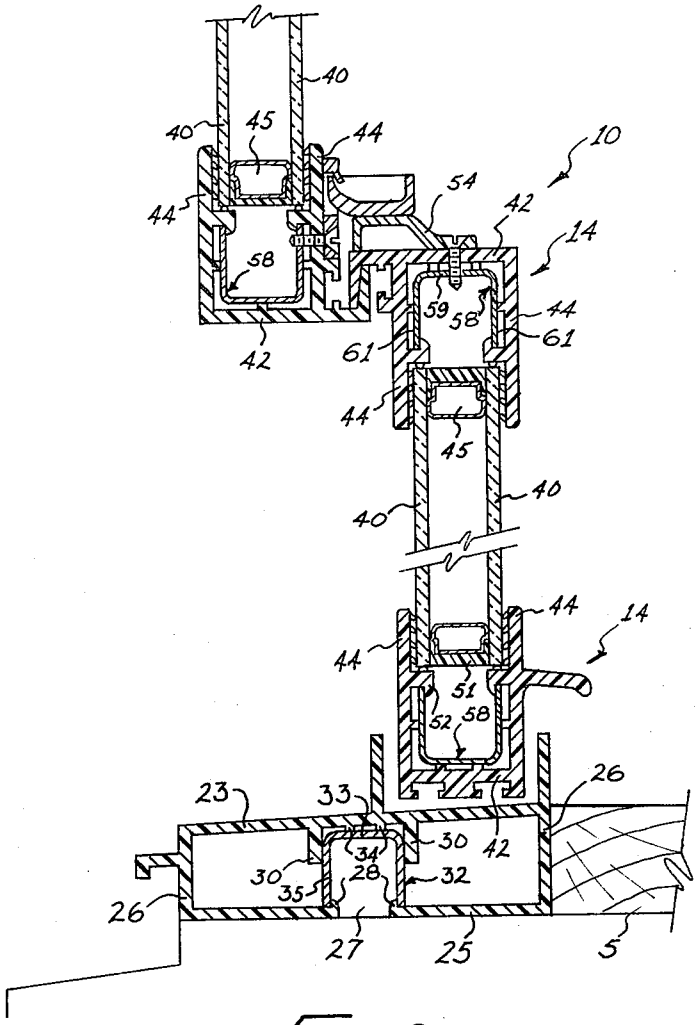
FIG. 2 is a fragmentary longitudinal sectional view taken along line 2—2 of FIG. 1.
Figure 5:
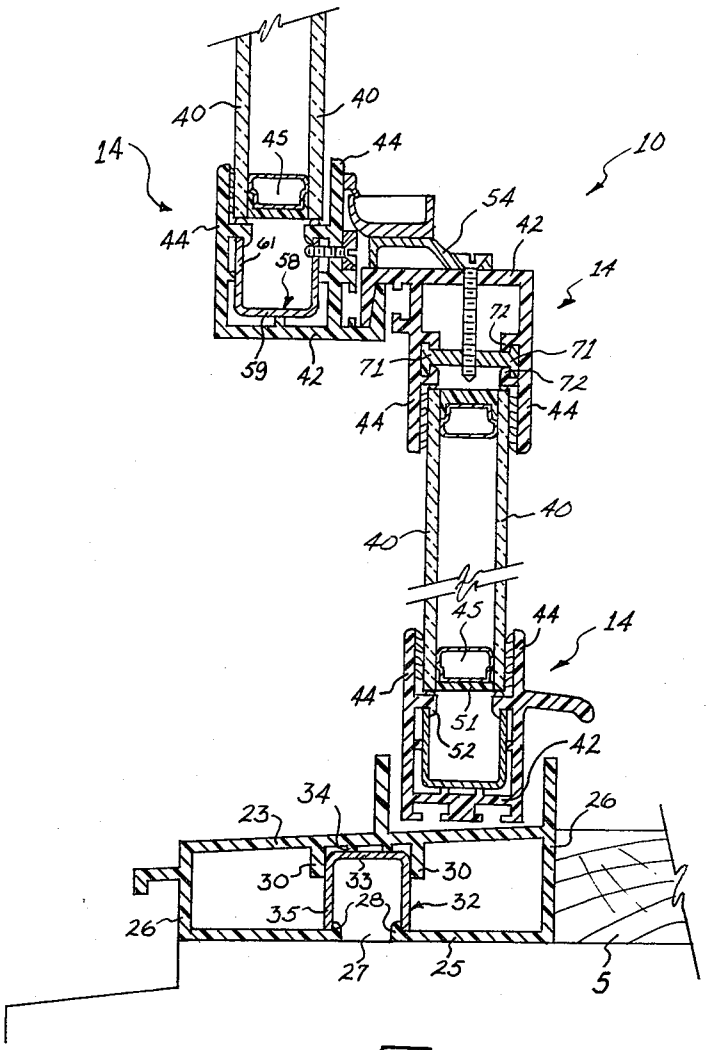
FIG. 5 is a fragmentary longitudinal sectional view like FIG. 2 but showing another embodiment of the invention.
Figure 4:
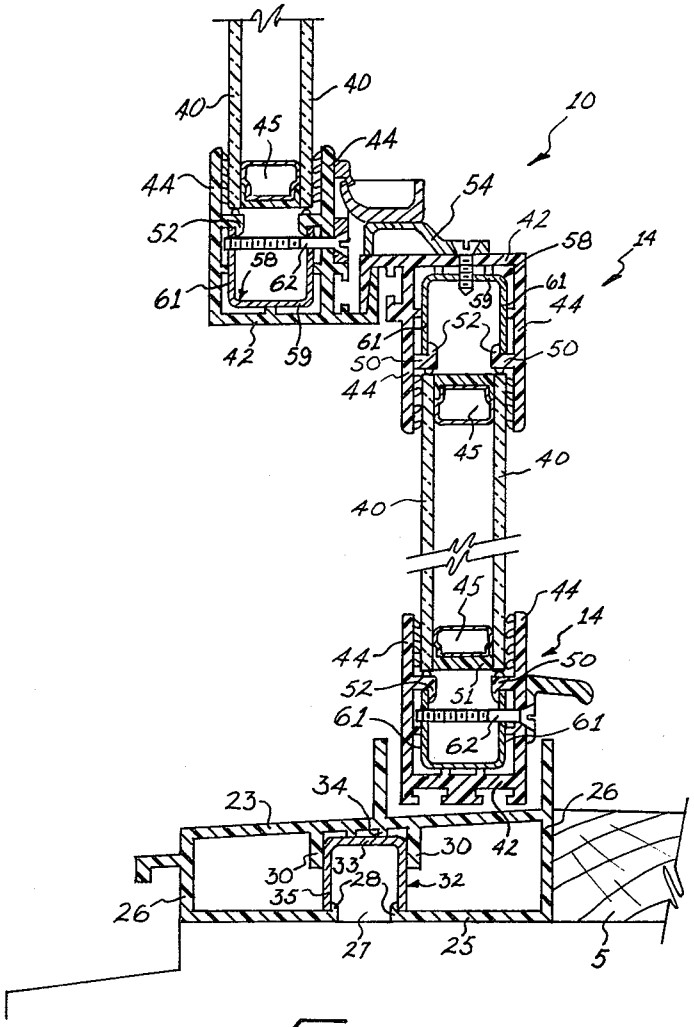
FIG. 4 is a fragmentary longitudinal sectional view like FIG. 2 but showing another embodiment of the invention.

In the embodiments of FIGS. 2, 4 and 5, a generally U-shaped rigid insert 32 is fitted into the frame parts between legs 30 with its base 33 seated against inner side 23, which because of its incline in sill part 22 includes spacer ribs 34. Lips 28 of outer side 25 fit around the sides 35 of the insert at their end edges which contact side 25. In this manner insert 32 forms a brace between sides 23 and 25 of the frame part.

Figure 3:
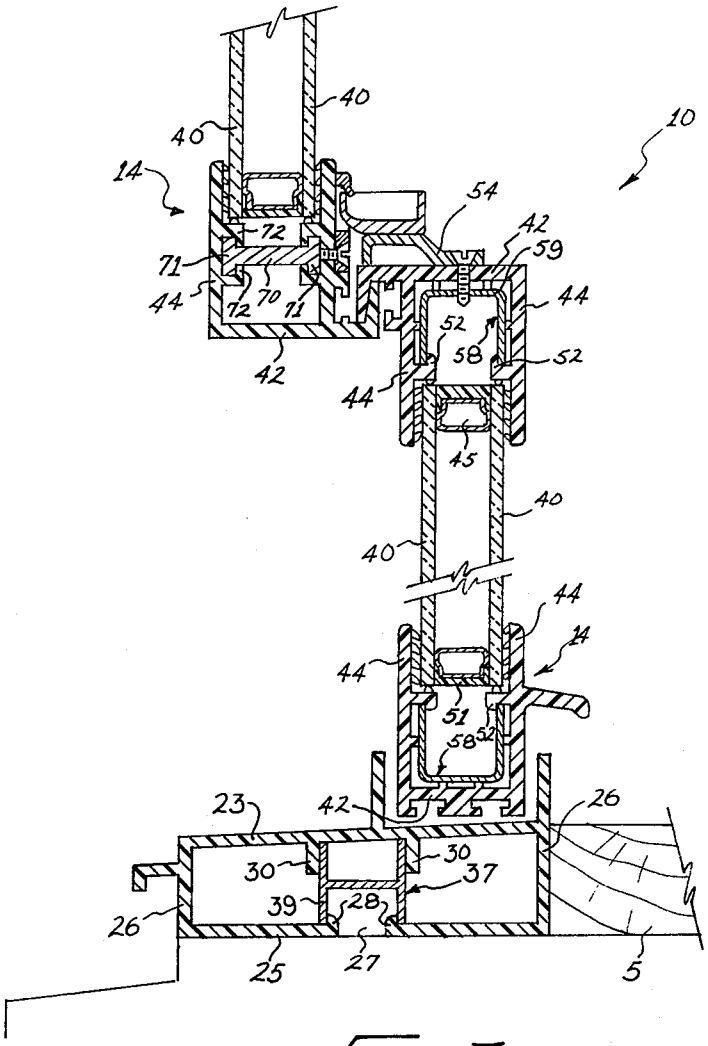
FIG. 3 is a fragmentary longitudinal sectional view like FIG. 2 but showing a second embodiment of the invention.

In FIG. 3, the insert 37 is generally H-shaped with its parallel sides 39 each being retained between frame part legs 30 and extending from one side 23 to the other side 25 of the frame part. Frame part lips 28 fit around insert side 39. Insert 37 also serves as a brace for the frame part.

In each window panel 13, double glazing panels 40 are shown fitted into surrounding sash members 14. Each sash member 14 is channel-shaped, of an open compartment construction, and has a generally uniform cross-section except for attached components such as latch 54. The glazing panels 40 are supported by spacers 45. Each sash member 14 has a base 42 and spaced side walls 44. Opposed longitudinally extruding flanges 50 extend from side walls 44 and terminate in an inturned lip 52. Glazing panels 40 extend at their marginal edges into the open end of sash member 14 between side walls 44 to flanges 50. A gosset 51 is placed between panels 40 and sash member side walls 44 as a sealant.

In FIG. 2, a U-shaped rigid insert 58 is fitted into each sash member 14 between side walls 44 with its base 59 extending to base 42 of the sash member. The sides 61 of insert 58 lie along sash member side walls 44 with lips 52 thereof fitting over the end edge of the insert sides to secure the insert to the sash member. The rigid support of insert 58 stiffens side walls 42 of the sash member and may be used to fasten components, such as latches 54, to the sash member.

In FIG. 4, insert 58 may be used to draw side walls 44 of sash members 14 toward each other and into a snug fit with glazing panels 40. Such a result may be accomplished with a screw 62 or similar attachment means which passes freely through one side wall 44 and the adjacent side 61 of the insert and which is threaded through the opposite insert side 61. By tightening screw 62, one wall 61 is drawn to the other wall 61 of the sash member.

In FIGS. 3 and 5, an I-beam shaped rigid insert 70 is utilized in a sash member 14. The flanged ends 71 of each insert member 70 are fitted into channels formed by opposed lips 72 which extend outwardly from and longitudinally along the inner face of the sash member side walls 44. Insert 70 serves to stiffen the side walls 44.

It is to be understood that the invention is not to be limited to the above description but may be modified within the appended claims.

What I claim is:

1. In combination, a sash assembly and a glazing panel, said sash assembly including sash members forming frame means for holding said glazing panel about its periphery, the improvement wherein at least one sash member has a base and spaced side walls extending from said base to define an open channel to the base, said side walls having opposed inner faces, retainers extending into said channel from said side wall inner faces, a rigid support member fitted between said side wall inner faces within said channel and interlocking with said retainers to provide rigidity to said spaced side walls, said glazing panel being positioned between said side walls and supported by said one sash member in a spaced relationship from said rigid support member.

2. The combination of claim 1 wherein said retainers are opposed and each include spaced opposed lips defining a restricted channel therebetween, said support member having a general I-beam cross-sectional configuration with opposite flanged ends, a said flanged end inserted into a said restricted channel with said opposed lips defining the channel overlying said inserted flanged ends.

3. The combination of claim 2 wherein said support member end flanges are juxtaposed with said one sash member side walls.

4. The combination of claim 1 wherein said retainers are spaced generally oppositely located flanges each terminating in a lip directed toward said sash member base, said support member having a general U-shaped cross-sectional configuration including a base and spaced sides extending therefrom and terminating in end edges, said support member base being positioned adjacent said sash member base and each support member side being positioned adjacent a said sash member side wall with said retainer flange lips fitted around said support member side end edges wherein said each sash member side wall is secured to a said support member side for rigidity.

5. The combination of claim 4 and a threaded fastening means extending through one sash member side wall and the adjacent support member side and being threaded into the other said support member side for drawing said support member sides and said secured sash member sides toward each other when said fastening means is tightened.

6. The combination of claim 1 and a frame guidably enclosing said sash member, said frame adapted for insertion into an opening in a building structure and including sill, jamb and header parts, at least one of said frame parts including spaced inner and outer sides, said outer side having a longitudinally extending slot therein defined by spaced end edges each terminating in an inturned lip directed towards said inner side wall, a second rigid support member fitted between said inner and outer sides, said second support member extending from said inner side to said outer side and engaging said lip at each outer side end edge to provide rigidity to said one frame part.

7. The combination of claim 4 and means extending inwardly from said sash member base and each sash member side wall for contacting said support member and spacing it from the sash member base and each sash member side wall.

* * * * *